United States Patent [19]

Hills

[11] 4,235,042

[45] Nov. 25, 1980

[54] TOSS AND CATCH HAND PUPPET

[76] Inventor: Isaac Hills, c/o Rincon Mfg. Co., Inc., 168 39th Street, Brooklyn, N.Y. 11232

[21] Appl. No.: 47,329

[22] Filed: Jun. 11, 1979

[51] Int. Cl.[3] ..... A63H 3/14

[52] U.S. Cl. ..... 46/154; 46/DIG. 1; 273/DIG. 30; 273/414

[58] Field of Search ..... 46/DIG.1, 154, 156, 46/157, 158, 151; 273/DIG. 30, 58 C, 26 E, 185 C, 200 R, 319, 329, 330, 414

[56] References Cited

U.S. PATENT DOCUMENTS

| | | | |
|---|---|---|---|
| 1,228,575 | 6/1917 | Lynch | 273/319 X |
| 1,417,860 | 5/1922 | Reich | 46/154 |
| 3,365,839 | 1/1968 | Luchsinger | 273/414 X |
| 3,731,927 | 5/1973 | Rocco, Jr. | 273/26 E |
| 3,789,547 | 2/1974 | Chemarin | 46/158 |
| 3,953,030 | 4/1976 | Muchnick | 46/DIG. 1 X |
| 4,122,628 | 10/1978 | Crowell et al. | 46/156 X |

*Primary Examiner*—Robert Peshock
*Assistant Examiner*—Mickey Yu
*Attorney, Agent, or Firm*—Kirschstein, Kirschstein, Ottinger & Cobrin

[57] ABSTRACT

A manipulative hand puppet in which an object is fastened to the puppet by a flexible elastic string. A flexible hook patch and a flexible pile patch are provided. One patch is secured to the outer surface of the puppet and the other is secured to the outer surface of the object. The puppet is manipulated by grasping the object and tossing the object away from the puppet. The string is thus extended and this causes the object to move back to contact with the puppet, whereupon the patches mate and the object is caught and held to the puppet until again grasped and tossed away from the puppet. Various embodiments simulate a baseball player puppet playing with a baseball object, a football player puppet playing with a football object, and a dog puppet playing with a bone-shaped object.

19 Claims, 4 Drawing Figures

TOSS AND CATCH HAND PUPPET

BACKGROUND OF THE INVENTION

1. Field of the Invention

A hand puppet action toy.

2. Description of the Prior Art

Hand puppets have been used and enjoyed by young and old for centuries. In the usual hand puppet, the puppet is mountable on a single human hand, and is provided with a hollow body usually including a head which simulates a recognizable character, and two opposed hollow limbs which extend from the body. A human hand is receivable in the hollow body, with a different finger of the human hand extending into each of the hollow limbs, so that motion of the fingers at will causes the puppet to move about in any desired life-like manner. It would be desirable to provide a hand puppet with an integral discrete object, so that a game of toss-and-catch may be played with the hand puppet. Also, it would be desirable to provide a means for detachably attaching the object to the hand puppet when it is caught in a target area.

Fasteners such as Velcro, and constituting two patches or tapes of different natures, are described in U.S. Pat. Nos. 2,717,437; 3,009,235; 3,076,244; 3,083,737; 3,147,528; 3,154,837; and 4,058,853. The usual Velcro fastener includes two mating patches, linear tapes or the like, one provided with a multiplicity of closely spaced plastic monofilamentary loops in the form of a pile, and the other provided with a plurality of closely spaced monofilamentary plastic hooks. The flexible resilient hooks patch, and the loops or pile patch, are typically composed of a plastic such as nylon, polyvinyl chloride, polyvinyl acetate, polyethylene, polypropylene, especially isotactic polypropylene, etc., although metallic wire could be used, such as copper wire, steel wire, brass wire, aluminum wire, etc.

Toys embodying toss-and-catch, deposition of an object on a target area, etc., and including in some cases the use of Velcro, are described in U.S. Pat. Nos. 4,017,076; 3,953,030; 3,917,271; 3,857,566; 3,790,168; 3,688,348; 3,508,280; 3,153,537; 3,032,345 and 2,142,068.

SUMMARY OF THE INVENTION

1. Purposes of the Invention

It is an object of the present invention to provide an improved hand puppet for the fun and amusement of young and old alike.

Another object is to provide an improved toss-and-catch manipulative hand puppet.

A further object is to provide a hand puppet action toy with an object to be played with in conjunction with the puppet itself.

An additional object is to provide a hand puppet with integral discrete object which is detachably attachable to a target area of the puppet.

Still another object is to provide a manipulative hand puppet in which an object, which is detachably attachable to the puppet per se, is fastened to the puppet by a flexible elastric string.

Still a further object is to provide a hand puppet action toy which simulates the action of a game such as baseball or football, or the action of a dog playing with a bone.

Still another object is to provide a toss-and-catch manipulative hand puppet action toy which is cheaply and readily fabricated and assembled at low cost from readily available materials in mass production facilities using unskilled labor.

These and other objects and advantages of the present invention will become evident from the description which follows.

2. Brief Description of the Invention

In one embodiment of the present toss-and-catch manipulative hand puppet, the invention entails the provision of a hand puppet simulating an animal, e.g. a dog. The hand puppet is provided with a Velcro patch at or adjacent to its mouth. This patch could be either a hooks patch or a loops patch. A mating patch is provided on a toy bone which is tethered and connected to the toy dog hand puppet, e.g. at its neck, by an elastic cord. The hand puppet per se is a conventional one with a pocket inside the head to receive an operator's middle finger and a pocket in each arm to receive, respectively, the operator's index and ring fingers. The three fingers are moved to manipulate the puppet's head and arms.

The child or other operator manipulates the toy to throw the tethered bone away from the dog. This stretches the elastic cord and causes the bone to snap back or to flip into contact with the dog's mouth (if the same is properly manipulated by the child), whereupon the mating Velcro patches cause the bone to be temporarily attached to the dog's mouth.

To continue playing with the toy, the child merely pulls the toy bone away from the toy dog's mouth. This is accomplished in the hand puppet by providing Velcro patches on the dog's front paws. The child merely pulls the bone away from the dog's mouth with his fingers (using one or both of the dog's paws), and then flips the bone outward again to continue playing with the hand puppet toy. The Velcro patches on the dog's paws are of the same type as the mouth patch.

With regard to Velcro per se, this material constitutes two flexible patches or tapes of different natures which are used for the detachable fastening. Each tape or patch is permanently secured to its respective member, in this case the dog's mouth, the bone, or the paws. The tapes or patches overlie each other in service. One tape has a multiplicity of closely spaced hooks; the other tape has a multiplicity of closely spaced loops in the form of a continuous pile. The hooks and loops are plastic monofilaments shaped to the desired configurations. When the tapes are pressed against one another, the hooks engage the loops to provide a closure which is reasonably resistant to opening forces. However, due to the resilience of the monofilaments, the tapes can be disengaged from each other either by applying a substantial pull in a direction perpendicular to their planes or by peeling them apart.

Thus the present invention basically entails the provision of a toss-and-catch manipulative hand puppet which includes a puppet having a hollow body and two opposed hollow limbs, and an object. The limbs extend from the body so that a human hand is receivable in the hollow body with a different finger of the human hand extending into each of the hollow limbs. One end of a flexible elastic string is connected to a point on the puppet, usually on the body, and the other end of the string is connected to a point on the object. A flexible hook patch and a flexible pile patch are provided. One of the patches is secured to the outer surface of the puppet, and the other of the patches is secured to the outer surface of the object.

The present hand puppet is simply and easily played with by a child or adult. The puppet, in place on the hand of the user as described supra, is manipulated by grasping the object and tossing the object away from the puppet. The string is thus extended, and this causes the object to snap or move back to contact with the puppet, whereupon the patches mate, and the object is caught and held to the puppet, until again grasped and tossed away from the puppet.

Various embodiments of the present toss-and-catch manipulative hand puppet simulate a baseball player puppet playing with a baseball object; a football player puppet playing with a football object; or a dog puppet playing with a bone-shaped object, the latter embodiment having been described in detail supra.

In one preferred embodiment, the one of the patches is secured to the outer surface of an extremity of one of the hollow limbs of the puppet. In this case, typically the one of the patches is in two portions, each portion of the one of the patches being secured to the outer surface of an extremity of a different one of the hollow limbs of the puppet. In this embodiment of the invention, in one typical case, the puppet is a humanoid puppet simulating a baseball player, the one of the patches is secured to the outer palm surface of a hand of one of the hollow arms of the puppet, and the object is a spherical ball. In this instance of a baseball player humanoid puppet, typically the one of the patches is in two portions, each portion of the one of the patches being secured to the outer palm surface of a different hand of the two opposed hollow arms of the puppet. One of the hands of the two opposed hollow arms of the baseball player puppet may be covered with a simulated glove, and in this case one of the two portions of the one of the patches will be secured to the palm of the glove. In most instances, the other of the patches will extend completely over the entire outer surface of the spherical ball.

Another embodiment of hand puppet, as mentioned supra, is that of a puppet simulating a dog having a head, hollow limbs simulating two legs, and a simulated paw at the extremity of each leg. In this case, usually the object will be a simulated bone. The one of the patches will usually be divided into a first portion and a second portion, with the first portion of the one of the patches being secured to at least one of the paws of the puppet, and with the second portion of the one of the patches being secured to the mouth of the head of the puppet. In this case, typically and preferably the first portion of the one of the patches is divided into two parts, with each part of the first portion of the one of the patches being secured to the outer palm surface of a different paw of the two opposed hollow simulated legs of the dog puppet. Typically when the object is a simulated bone, the other of the patches will extend completely over the entire outer surface of the simulated bone object.

In the case where the puppet is a humanoid puppet simulating a football player, usually the one of the patches will be secured to the chest of the puppet, and the object will be in the shape of a football. It is preferred that the one of the patches in this case should be in two separate portions, secured in juxtaposition to the chest of the puppet. In this case, usually the two separate portions will be vertically aligned, one above the other, on the chest of the puppet. Typically in this case of a football player humanoid puppet, the other of the patches will extend completely over the entire outer surface of the football-shaped object.

Generally, in most cases the object will be resilient and deformable and will include an outer cover layer such as cloth, thin plastic sheeting or film, or natural or artificial leather. The inner filling may consist of a deformable material such as foamed polyurethane, foam rubber, excelsior or sawdust. It is preferred that the one of the patches be a flexible hook patch and the other of the patches be a flexible pile patch, however it will be understood by those skilled in the art that a reverse arrangement of the patches is of course feasible.

Usually the one end of the string will be connected to a point on the body of the puppet. Thus, e.g. the body of the puppet will usually include a head and an upper torso, the head and the upper torso being connected by a neck, with the one end of the string being connected to a point on the neck of the puppet body. Preferably, the point on the neck, to which the one end of the string is connected, is immediately below the chin of the head of the puppet.

The present toss-and-catch manipulative hand puppet provides several salient advantages. The toy is an improved hand puppet which provides fun and amusement for young and old alike. Playing with the toy is analogous to a contest, e.g. in the case of a dog, to see whether the toy may be manipulated so that the simulated bone object lodges at the mouth of the dog. The present hand puppet is an action toy, with an object to be played with in conjunction with the puppet itself. Thus, the hand puppet has an integral discrete object which is detachably attachable to a target area of the puppet, after the object has been tossed away from the puppet and rebounds towards the puppet due to elongation and stretching of the flexible elastic string. Thus, a manipulative hand puppet is provided in which an object, which is detachably attachable to the puppet per se, is fastened to the puppet by a flexible elastic string. The present hand puppet action toy simulates the action of games with which the child or adult can readily identify, such as baseball or football, or the action of a dog playing with a bone. Finally, the present toss-and-catch manipulative hand puppet action toy is cheaply and readily fabricated and assembled at low cost from readily available materials, and in mass production facilities using unskilled labor on assembly lines which are not of a complex nature.

The invention accordingly consists in the features of construction, combination of elements, and arrangement of parts which will be exemplified in the article of manufacture herein after described, and of which the scope of application will be indicated in the appended claims.

BRIEF DESCRIPTION OF THE DRAWINGS

In the accompanying drawings in which are shown several of the various possible embodiments of the invention.

DETAILED DESCRIPTION OF THE PREFERRED EMBODIMENTS

Figure 1:
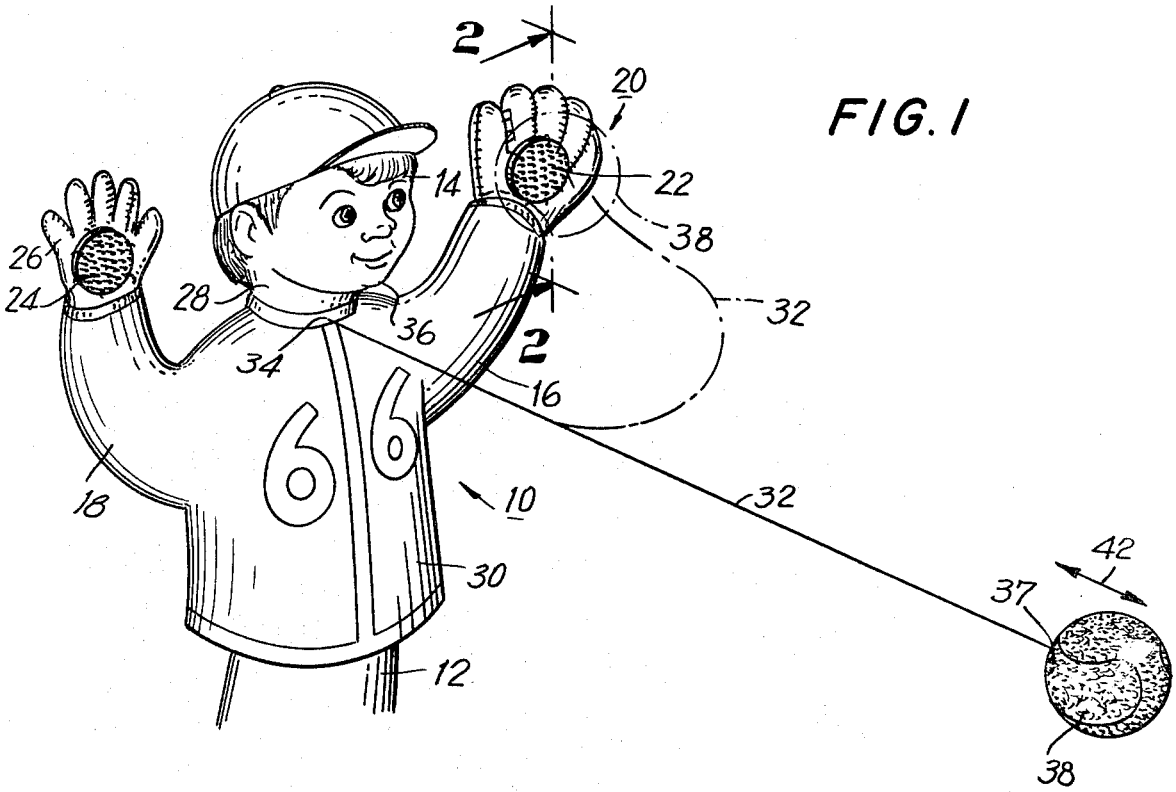
FIG. 1 shows a toss-and-catch manipulative hand puppet in the form of a simulated baseball player puppet playing with a baseball object.
Figure 2:
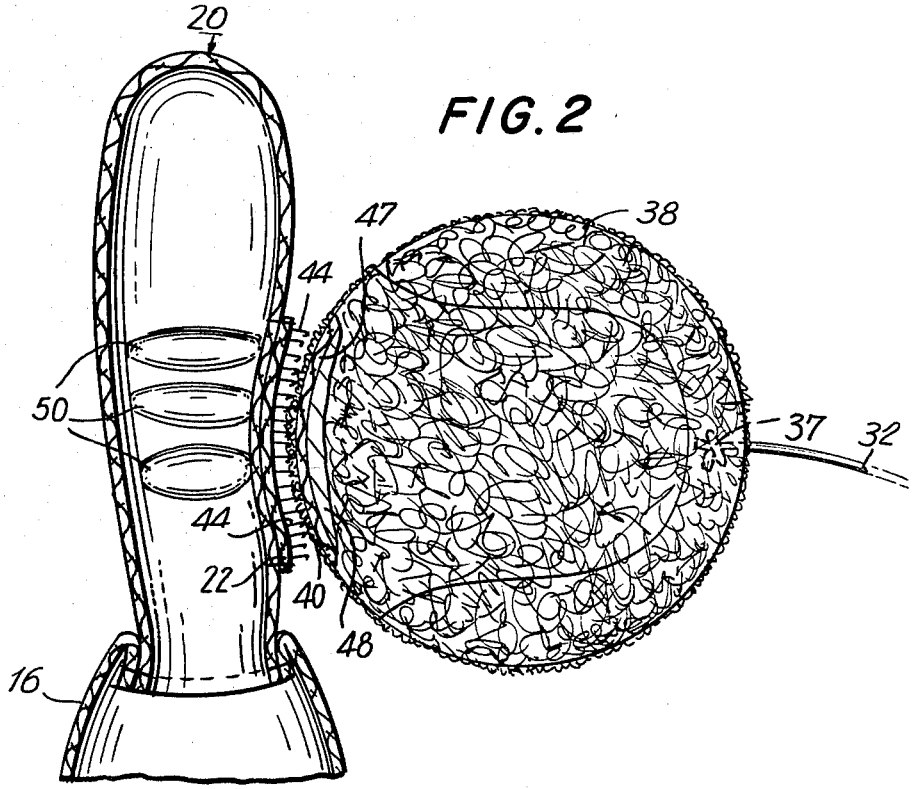
FIG. 2 is a partial sectional elevation view taken substantially along the line 2—2 of FIG. 1.

Referring now to FIGS. 1 and 2, a hollow humanoid hand puppet 10 in the form of a simulated baseball player is held on a forearm 12 of the person using, i.e. playing with, the hand puppet 10. The person's hand, not shown by virtue of being covered by the hand puppet 10, is so disposed within the hand puppet 10 and at the terminus of the forearm 12 that the index finger of the hand extends into the hollow head 14 of the hand puppet 10; the thumb of the hand extends into the hollow left arm 16 of the hand puppet 10; and the middle finger of the hand extends into the hollow right arm 18 of the hand puppet 10. Thus, the elements 14, 16 and 18 may be readily manipulated at will by the user, by moving one or more of the fingers of the hand which is inside the hollow hand puppet 10 and at the terminus of the arm 12.

A simulated baseball glove 20 is provided at the terminus of the arm 16, and a circular Velcro hooks patch 22 is centrally disposed on and mounted to the simulated glove 20. Similarly, a circular Velcro hooks patch 24 is centrally disposed on and mouned to a simulated hand 26 at the end of the arm 18.

The hand puppet 10 also includes a neck 28 and an upper torso 30. One end of a flexible elastic string 32 is connected at 34 to the front and center of the neck 28 immediately below the chin 36 of the head 14. The flexible elastic string 32 extends from the point 34 to a connection at 37 to an object 38 consisting in this case of a simulated spherical baseball completely covered with a velcro pile or loops patch or layer 40. FIG. 1 shows via arrow 42 the outward thrust or throwing of the ball 38, with concomitant elongation of the flexible elastic string 32, which results in an inward pull of the string 32 against the ball object 38 and towards the hand puppet 10.

FIG. 1 shows in phantom outline, and FIG. 2 shows in detail the resultant lodging of the ball object 38 against the hooks patch 22, i.e. when the hand puppet 10 is successfully manipulated and played with, the ball object 38 lodges against and becomes temporarily and detachably attached to the Velcro hooks patch 22 and/or to the hooks patch 24. FIG. 2 shows this disposition of the elements in detail, with the hooks 44 of the hooks patch 22 being interdispersed into and catching on to the loops 46 of the loops or pile patch 40. FIG. 2 also shows the skin or covering layer 47 of the object 38, which outer layer 47 is completely covered by the loops patch 40; the layer 47 consisting generally of any suitable deformable material such as cloth, thin plastic sheeting or film, or natural or artificial leather, etc. FIG. 2 also shows inner filling 48 within the object 38; this filling 48 may consist of any suitable deformable material such as foamed polyurethane, foam rubber, excelsior, sawdust, etc.

As shown in FIG. 2, due to the contact of the elements 22 and 38 due to the impinging of the ball 38 on the hooks patch 22, the patch 22 has becme slightly concave while the surface of the ball 38 at the interface remains slightly curved with only partial contact with the hooks patch 22.

FIG. 2 also shows curved representations 50 of the bases of other fingers of the glove 20. A numeral 66 appears on the torso or jacket 30 of the hand puppet 10, to further simulate a baseball player.

Figure 3:
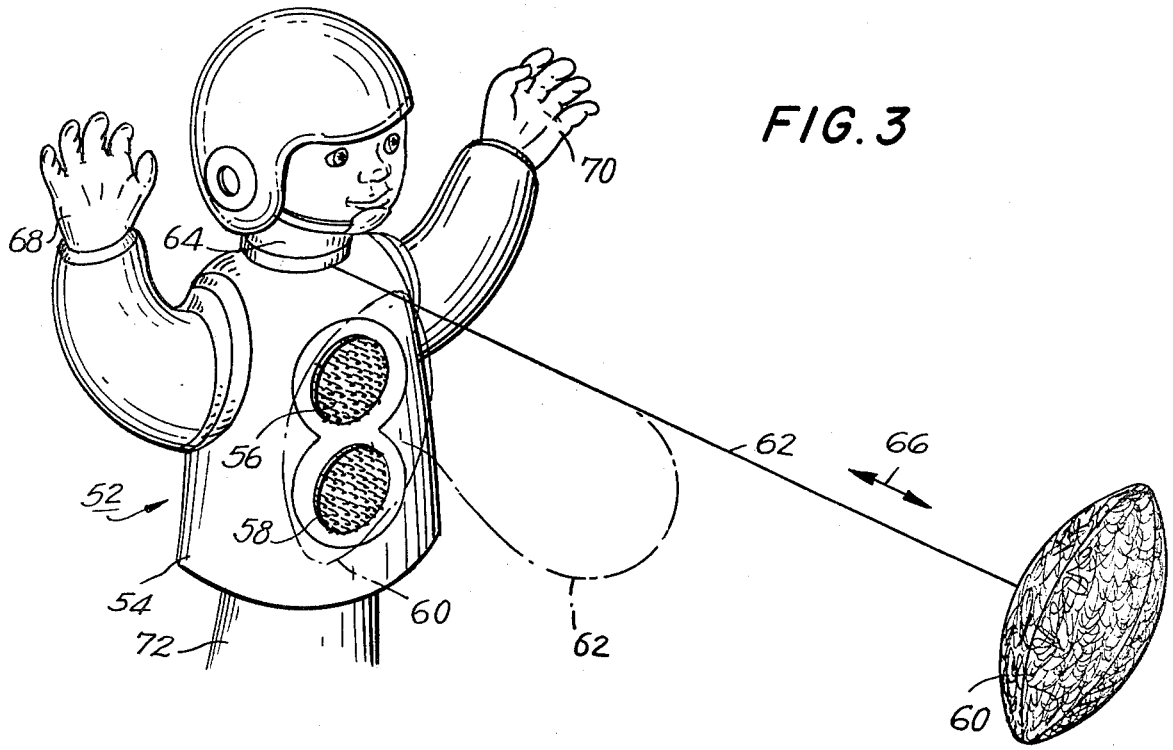
FIG. 3 shows a hand puppet in the form of a simulated football player puppet playing with a football object.

FIG. 3 illustrates a humanoid football player hand puppet 52. The torso 54 of the hand puppet 52 is provided with two circular Velcro hooks patches 56 and 58 juxtaposed in vertical alignment with patch 56 immediately above patch 58. The object in this case is a simulated football object 60 totally covered with a Velcro loops or pile patch, and connected via flexible elastic string 62 to the neck 64 of the football player hand puppet 52. The phantom outline of elements 60 and 62 shows their disposition when the stretched or elongated string 62, as indicated by arrow 66, has caused the football object 60 to rebound so that the Velcro patches are mated, and the hand puppet 52 has been successfully played with. A numeral 8 appears on the chest of the torso 54 with the patches 56 and 58 being disposed, as shown, within the circles of the numeral 8. In this embodiment of the invention, the hands 68 and 70 of the hand puppet 52 are devoid of Velcro patches so that manipulation of the hand puppet 52 to again throw the object 60 outwards, and away from the puppet, is readily accomplished by grasping the object 60 in the hands 68 and 70, which are manipulated by fingers, not shown, of a human hand within the hollow hand puppet 52 and at the terminus of a human forearm 72.

Figure 4:
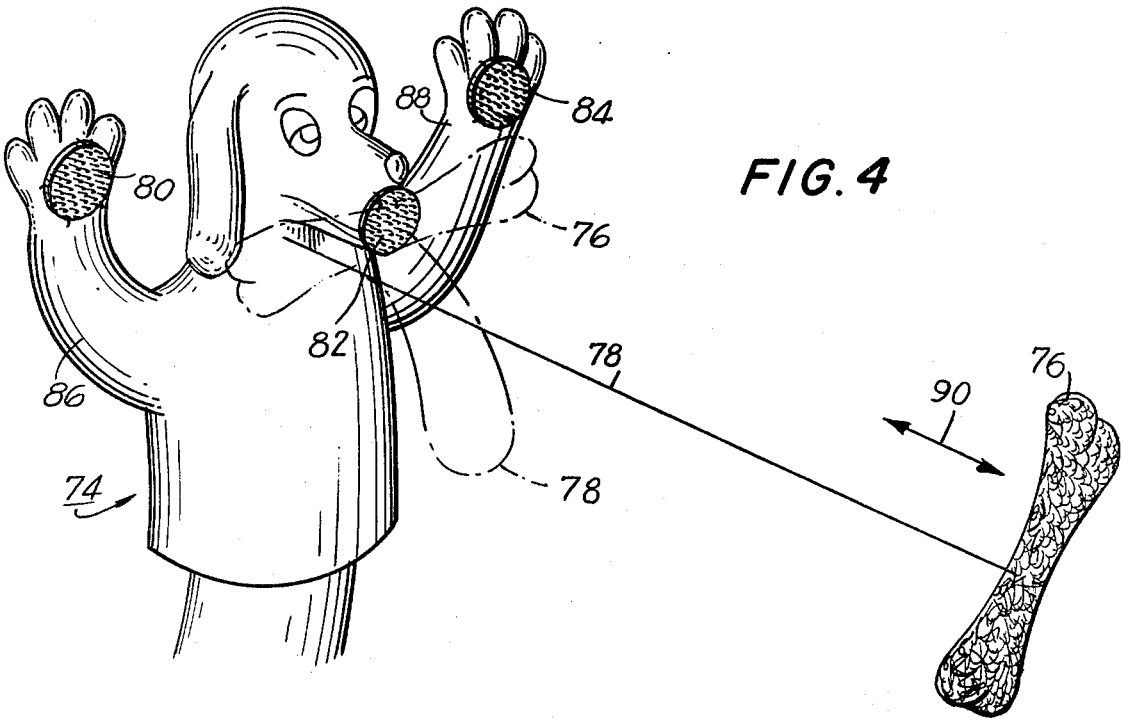
FIG. 4 shows a hand puppet in the form of a simulated dog puppet playing with a bone-shaped object.

FIG. 4 shows a simulated pet dog hand puppet 74 playing with a simulated bone object 76, which object 76 is attached to the hand puppet 74 via flexible elastic string 78. The object 76 is covered with a Velcro loops patch, while Velcro hooks patches 80, 82 and 84 are respectively provided on the right paw, mouth and left paw of the hand puppet 74. Thus the bone object 76 may be lodged against and temporarily attached to any of the patches 80, 82 or 84, however the object 76 is easily grasped by the user by manipulating the dog's legs 86 and 88 so that the object 76 may be concomitantly attached to both of the patches 80 and 84 in registration, not shown. In any event, the object 76 as shown in phantom outline indicates a successful conclusion of playing with the hand puppet, i.e. the simulated bone object 76 has lodged at the dog's mouth, i.e. the object 76, in phantom outline, has become attached to the hooks Velcro patch 82. Arrow 90 indicates the action and reaction of the string 78 when the object 76 is thrown or tossed away from the hand puppet 74.

It thus will be seen that there is provided a toss-amd-catch manipulative hand puppet which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A toss-and-catch manipulative hand puppet comprising a puppet, said puppet having a hollow body and two opposed hollow limbs, and an object, said limbs extending from said body, so that a human hand is receivable in said hollow body with a different finger of said human hand extending into each of said hollow limbs, a flexible elastic string, one end of said string being connected to a point on said puppet, the other end of said string being connected to a point on said object, a flexible hook patch, and a flexible pile patch, one of said patches being secured to the outer surface of said puppet, the other of said patches being secured to the outer surface of said object.

2. The hand puppet of claim 1 in which the one of the patches is secured to the outer surface of an extremity of one of the hollow limbs of the puppet.

3. The hand puppet of claim 2 in which the one of the patches is in two portions, each portion of the one of the patches being secured to the outer surface of an extremity of a different one of the hollow limbs of the puppet.

4. The hand puppet of claim 2 in which the puppet is a humanoid puppet simulating a baseball player, the one of the patches is secured to the outer palm surface of a hand of one of the hollow arms of the puppet, and the object is a spherical ball.

5. The hand puppet of claim 4 in which the one of the patches is in two portions, each portion of the one of the patches being secured to the outer palm surface of a different hand of the two opposed hollow arms of the puppet.

6. The hand puppet of claim 5 in which one of the hands of the two opposed hollow arms of the puppet is covered with a simulated glove, and one of the two portions of the one of the patches is secured to the palm of said glove.

7. The hand puppet of claim 4 in which the other of the patches extends completely over the entire outer surface of the spherical ball.

8. The hand puppet of claim 1 in which the puppet simulates a dog having a head, hollow limbs simulating two legs, and a simulated paw at the extremity of each leg, and the object is a simulated bone, the one of the patches is divided into a first portion and a second portion, said first portion of the one of the patches being secured to at least one of the paws of the puppet, said second portion of the one of the patches being secured to the mouth of the head of the puppet.

9. The hand puppet of claim 8 in which the first portion of the one of the patches is divided into two parts, each part of the first portion of the one of the patches being secured to the outer palm surface of a different paw of the two opposed hollow simulated legs of the puppet.

10. The hand puppet of claim 8 in which the other of the patches extends completely over the entire outer surface of the simulated bone object.

11. The hand puppet of claim 1 in which the puppet is a humanoid puppet simulating a football player, the one of the patches is secured to the chest of the puppet, and the object is in the shape of a football.

12. The hand puppet of claim 11 in which the one of the patches is in two separate portions secured in juxtaposition to the chest of the puppet.

13. The hand puppet of claim 12 in which the two separate portions are vertically aligned, one above the other, on the chest of the puppet.

14. The hand puppet of claim 11 in which the other of the patches extends completely over the entire outer surface of the football-shaped object.

15. The hand puppet of claim 1 in which the object is resilient and deformable and includes an outer cover layer selected from the group consisting of cloth, thin plastic sheeting or film, and natural or artificial leather, together with an inner filling of a deformable material selected from the group consisting of foamed polyurethane, foam rubber, excelsior and sawdust.

16. The hand puppet of claim 1 in which the one of the patches is a flexible hook patch and the other of the patches is a flexible pile patch.

17. The hand puppet of claim 1 in which the one end of the string is connected to a point on the body of the puppet.

18. The hand puppet of claim 17 in which the body of the puppet includes a head and an upper torso, said head and said upper torso being connected by a neck, the one end of the string being connected to a point on said neck of the puppet body.

19. The hand puppet of claim 18 in which the point on the neck to which the one end of the string is connected is immediately below the chin of the head of the puppet.

* * * * *